United States Patent [19]

Holgado

[11] Patent Number: 4,481,125

[45] Date of Patent: Nov. 6, 1984

[54] WATER-BASED HYDRAULIC FLUID

[75] Inventor: Rosauro V. Holgado, Bala-Cynwyd, Pa.

[73] Assignee: E.F. Houghton & Co., Valley Forge, Pa.

[21] Appl. No.: 508,831

[22] Filed: Jun. 29, 1983

Related U.S. Application Data

[63] Continuation-in-part of Ser. No. 374,157, May 3, 1982, abandoned.

[51] Int. Cl.[3] ..... C10M 3/04; C10M 1/06

[52] U.S. Cl. ..... 252/75; 252/32.7 E; 252/33.6; 252/49.5; 252/76; 252/78.5; 252/79

[58] Field of Search ..... 252/32.7 E, 33.6, 49.5, 252/75, 76, 78.5, 79

[56] References Cited

U.S. PATENT DOCUMENTS

| | | | |
|---|---|---|---|
| 2,425,755 | 8/1947 | Roberts et al. | 260/615 |
| 2,425,845 | 8/1947 | Toussaint et al. | 260/615 |
| 3,005,776 | 10/1961 | Langer et al. | 252/77 |
| 3,036,118 | 5/1962 | Jackson et al. | 260/484 |
| 3,105,050 | 9/1963 | Fischer | 252/76 |
| 3,133,020 | 5/1964 | Scott | 252/33.6 |
| 4,138,346 | 2/1979 | Nassry et al. | 252/75 |
| 4,151,099 | 4/1979 | Nassry et al. | 252/76 |
| 4,209,414 | 6/1980 | Holgado et al. | 252/75 |
| 4,225,447 | 9/1980 | Law et al. | 252/34.7 |
| 4,253,975 | 3/1981 | Law et al. | 252/32.7 E |
| 4,257,902 | 3/1981 | Singer | 252/18 |
| 4,288,639 | 9/1981 | Camp | 568/625 |
| 4,289,636 | 9/1981 | Davis et al. | 252/49.3 |
| 4,310,436 | 1/1982 | Camp | 252/78.5 |
| 4,312,768 | 1/1982 | Nassry et al. | 252/32.7 E |
| 4,312,775 | 1/1982 | Panek et al. | 252/78.5 |
| 4,313,836 | 2/1982 | Nassry et al. | 252/32.7 E |
| 4,329,249 | 5/1982 | Forsberg | 252/34.7 |

FOREIGN PATENT DOCUMENTS

| | | |
|---|---|---|
| 0004426 | 10/1979 | European Pat. Off. . |
| 0024848 | 3/1981 | European Pat. Off. . |
| 1055337 | 1/1967 | United Kingdom . |

*Primary Examiner*—Paul Lieberman
*Assistant Examiner*—Robert A. Wax
*Attorney, Agent, or Firm*—Howson and Howson

[57] ABSTRACT

Water-based hydraulic fluid for use in industrial hydraulic systems comprising (1) a polyether-based thickener, (2) a lubricant modifier (3) a dispersant, (4) an EP additive, and (5) water. Preferably, the thickener is a polyether polyol capped with an alpha olefin oxide; the lubricant modifier is a combination of a hydrocarbon oil, a fatty alcohol and a glycol; the dispersant is the reaction product of an alkenyl succinic anhydride and a dialkyl alkanolamine, and the EP additive is a dialkyl dithiophosphate.

56 Claims, No Drawings

WATER-BASED HYDRAULIC FLUID

BACKGROUND OF THE INVENTION

This application is a continuation-in-part of application Ser. No. 374,157 filed May 3, 1982, now abandoned.

This invention relates to an improved high water-based hydraulic fluid particularly suitable for use in industrial hydraulic systems.

The technology of power transmission by means of a hydraulic fluid is well established. Various non-compressible fluids such as water and oil have been used as hydraulic fluids. Petrolueum oils have certain advantages over water as hydraulic fluids in that they reduce wear and inhibit rust formation in hydraulic system components such as pumps, and exhibit a higher viscosity than water, thus providing for reduced fluid leakage. Unfortunately, a major deficiency of petroleum oils is flammability. They are also sensitive to the intrusion of water into hydraulic systems in which they are employed. In addition, disposal of spent petroleum oil-based hydraulic fluids presents ecological problems.

In recent years, by reason of their low cost, efforts have been made to provide water-based hydraulic fluids of improved properties, such as enhanced anti-wear properties. One suggestion has been to include in an aqueous-based hydraulic fluid an extreme pressure (EP) additive, such as a dithiophosphate, along with a dispersing agent, because of the substantial water insolubility of such EP additives. Also, by reason of the substantially lower viscosity of water-based hydraulic fluids the inclusion therein of various types of thickeners has been suggested. However, various of such thickeners have evidenced shear instability resulting in significant viscosity reduction of aqueous-based hydraulic fluids containing such thickeners.

SUMMARY OF THE INVENTION

This invention relates to thickened, high viscosity, high water-based hydraulic fluids of the oil-in-water emulsion type. By the term "high water-based hydraulic fluids" is meant compositions comprising about 80% or more, by weight, of water. In addition to water, the hydraulic fluids of this invention contain as essential constituents (1) a polyether-based thickener, (2) a lubricant modifier, (3) a dispersant, and (4) an EP additive, all in specified proportions. Optionally, the hydraulic fluids of the invention may contain various emulsifiers, corrosion inhibitors, defoamers, coupling agents, freezing point depressants, and the like, depending upon the particular hydraulic system in which the hydraulic fluid is to be employed. Advantageously, the essential constituents of the hydraulic fluid may be combined to form a concentrate which is readily dilutable with water to provide a hydraulic fluid.

The high water-based hydraulic fluids of this invention provide improvements over prior known aqueous-based hydraulic fluids in the nature of more stable viscosity characteristics, reduced wear and better lubrication.

A high water-based hydraulic fluid according to the present invention can be obtained by blending together at a temperature of about 120°-180° F. (49°-82° C.), the lubricant modifier and dispersing agent, following which, after removal from heat, the EP additive is introduced to the blend. Water is then added and a uniform clear fluid is obtained. This clear fluid is then combined with the thickener, and additional water is added to provide a hydraulic fluid having the desired water content and viscosity. The optional constituents such as defoamers, corrosion inhibitors, etc. may be added at an appropriate time during preparation of the fluid.

Concentrates of the invention can be blended with a substantial amount of water to provide fire-resistant hydraulic fluids of improved lubricity and anti-wear characteristics, and of stable viscosity. Even at water concentrations in excess of 80%, by weight, the hydraulic fluids of this invention can be used effectively in systems containing vane pumps, and can replace standard hydraulic oils with reductions in cost.

DESCRIPTION OF THE PREFERRED EMBODIMENTS

In accordance with this invention, there are provided high water-based hydraulic fluids and concentrates which can be diluted with water to form such hydraulic fluids comprising (1) a polyether-based thickener, (2) a lubricant modifier, (3) a dispersant, (4) an EP additive, and (5) water. As is conventional, corrosion inhibitors, defoamers, metal deactivators, etc. may be included in the compositions. Such hydraulic fluids were found to undergo little reduction in viscosity in use.

THE LUBRICANT MODIFIERS

The lubricant modifiers which may be used in the novel hydraulic fluids of this invention include water immiscible liquids and also water-miscible or water soluble or dispersible liquids and mixtures of such liquids. These lubricant modifiers enhance the lubricating properties of the hydraulic fluids and also function as plasticizers to prevent the formation of tacky deposits in the hydraulic systems in which the hydraulic fluids are employed. In addition, the water-miscible or water dispersible fluids, such as the alkylene glycols defined more fully hereinafter, at higher concentrations, improve the fluidity and low temperature properties of the hydraulic fluids.

The water immiscible liquids which may be used as lubricant modifiers include such liquids as aliphatic, cycloaliphatic and aromatic hydrocarbons; chlorinated hydrocarbons; mineral oils; silicone oils such as a dimethyl and methyl phenyl silicones; fatty materials such as vegetable oils, fish oils, fatty acids, fatty alcohols, and fatty amines condensation products of fatty acids and alkanolamines, which may be phosphate-modified; ethoxylated fatty amides, organic esters such as di-2-ethylhexyl sebacate or azelate, and trimethylolpropane tricaprylate; glycols and polyglycols; triaryl phosphate esters such as triisopropyl phenyl phosphate; and polyphenyl ethers.

One group of preferred lubricant modifiers are the synthetic hydrocarbon oils of lubricating viscosity. Normally such oils, will range in viscosity from 50 to 700 Saybolt Universal Seconds (SUS) at 100° F. Such synthetic hydrocarbon oils are normally prepared by polymerizing lower monoolefins in the presence of a suitable catalyst such as $BF_3$ or $AlCl_3$. The lower olefins include, for example, ethylene, propylene, butylene, and the like. Other synthetic hydrocarbon oils are poly alpha olefins and alkyl benzenes. Such synthetic hydrocarbon fluids have adequate fluidity at low temperatures.

The water immiscible lubricant modifiers may comprise naturally occuring hydrocarbons such as mineral oils which may be either paraffinic or naphthenic in nature. Such mineral oils should have a viscosity of from about 50 to 700 SUS at 100° F. A preferred mineral oil for use in the hydraulic fluids of this invention is a light lubricating oil of the naphthenic type having a viscosity of 80 to 200 SUS at 100° F., a particularly preferred oil of this type having a viscosity of 100 to 150 SUS at 100° F.

Another group of preferred lubricant modifiers are the condensation products of fatty acids and alkanolamines. These products, which are water dispersible, may be prepared by reacting a fatty acid or fatty ester with an alkanolamine at temperatures on the order of 100° to 160° C. with removal of water of condensation or alcohol. The mol ratio of fatty acid or ester to amine may be in the range of from about 2:1 to about 1:3. Optionally, a small amount, e.g. 0.01 to 0.05 mols of phosphoric acid may be present during the reaction.

The fatty acids used in the preparation of the condensates generally should contain from 7 to 22, preferably 12 to 18 carbon atoms and may be saturated or unsaturated, or a mixture of both. Thus, fatty acids suitable for use in preparing the condensates include heptanoic, caprylic, pelargonic, capric, lauric, myristic, palmitic, stearic, oleic and behenic acids. A preferred fatty acid reactant is a mixture of stearic and oleic acids.

Alkanolamines which have been found useful in preparing the condensates include ethanolamine, isopropanolamine, N-methyl ethanolamine, diethanolamine, dipropanolamine, diisopropanolamine, and triethanolamine. A particularly preferred alkanolamine is diethanolamine.

Another group of preferred water soluble/dispersible lubricant modifiers are the ethoxylated fatty amides, amines, alcohols and vegetable oils. The alkyl group of these fatty materials generally should contain from 7 to 22, preferably 12 to 18 carbon atoms. Such alkyl groups include heptanoyl, caprylyl, nonanoyl, capryl, lauryl, myristyl, stearyl, oleyl and behenyl. Such lubricant modifiers may comprise the fatty material derived from vegetable oils, such as, palmitic, coconut, castor, rapeseed, soya bean, corn, peanut, sunflower oil, and the like. In addition such fatty material my be derived from animal fat like tallow, lard, fish oil and the like.

The degree of ethoxylation of these water soluble/-dispersible lubricant modifiers should be between 1 to 20 preferably 4 to 6 moles of ethylene oxide to one mole of fatty amide, amine, alcohol or vegetable oil.

A preferred group of lubricant modifiers which are water soluble are the alkylene and poly alkylene glycols having the formula $RO(C_nH_2nO)_xH$, where R is hydrogen or an alkyl group containing 1 to 10 carbon atoms, n is an integer from 2 to 6 and x is an integer from 1 to 70. The alkylene glycols include ethylene and propylene glycol and their higher homologs such as diethylene and dipropylene glycol. The preferred alkylene glycol is ethylene glycol.

Suitable water miscible or water dispersible polyoxyalkylene glycols include polyoxyethylene, polyoxypropylene and poly(oxyethylene, oxypropylene) glycols having molecular weights of from about 200 to about 4000. These polyglycols may be uncapped or capped at the end by a lower alkyl group containing from 1 to 10 carbon atoms. The weight percent of the oxyethylene in the poly(oxyethylene, oxypropylene) glycols should be on the order of at least about 20%. A particular preferred polyglycol is the monobutyl ether of poly(oxyalkylene-oxy-1,2-propylene) glycol having a molecular weight of about 1500 to 4000.

Generally the lubricant modifiers will comprise from about 0.50 to about 20% by weight of the hydraulic fluid. Preferred hydraulic fluids of the invention contain on the order of 1.0 to 10% of lubricant modifier.

THE THICKENER

The polyether-based thickeners used in the hydraulic fluids of this invention are relatively high molecular weight polyoxyalkylene compounds, also referred to herein as polyether polyols, which may be capped by means of an alpha olefin oxide. The thickeners are water-soluble, or at least water-dispersible. The preferred thickeners are the alpha olefin capped polyoxyethylene-polyoxypropylene block copolymers containing on the order of about 20 to 35%, by weight, of 1,2-propylene oxide groups.

The polyether-based thickeners useful in the water-based hydraulic fluids of this invention are preferably two types of normally liquid polyether polyols. Each type is obtained by reacting ethylene oxide, at least one lower alkylene oxide having 3 to 4 carbon atoms, and an active hydrogen compound. However, in one type of thickener, the active hydrogen compound is an aliphatic alcohol having two or more hydroxy groups in the molecule, while in the other type it is an aliphatic monohydric alcohol containing from 4 to 30, preferably 12 to 18, carbon atoms in the aliphatic group. In either instance, these polyether polyols, which may be heteric or block copolymers, may be capped by reaction with an alpha olefin oxide having about 12 to 30, preferably 12 to 18 aliphatic carbon atoms. However, those thickeners in which the active hydrogen compound is a diol or polyol may be used in uncapped form, provided they have a sufficiently high molecular weight. Thus, such uncapped polyether polyols should have a molecular weight of at least 7,000 and may have a molecular weight as high as 75,000. Preferred uncapped polyether polyols of this type have a molecular weight of from about 10,000 to 30,000.

If the copolymer thickeners in which the active hydrogen compound is a diol or polyol are capped by reaction with an alpha olefin oxide, the molecular weight thereof should be on the order of 7,000 to 15,000, preferably about 12,000 to 14,000. In either instance, i.e. whether the polyether polyols are of relatively high, 20,000 plus, molecular weight, or of relatively low molecular weight, e.g. less than about 15,000, the weight percent of ethylene oxide groups should be on the order of 25% to 80%. Preferably, the copolymers contain about 20 to 35% of 1,2-propylene oxide groups.

The diols used as the active hydrogen containing compound in the reaction may be glycols, such as ethylene glycol, diethylene glycol and higher glycols. The diols may also contain oxyalkylene groups. Typical of the polyols which may be used as active hydrogen compounds are glycerol, polyglycerol and trimethylol propane.

In preparing these polyether polyols, good results may be obtained by bringing a mixture containing the ethylene oxide and the lower alkylene oxide into intimate contact with the diol or polyol starting compound in the liquid phase, throughout which a suitable catalyst is uniformly dispersed. As catalysts, sodium and potassium hydroxide are preferred. The reaction is carried out at temperatures on the order of 50° to 160° C.

Such polyether polyols in which the active hydrogen compound is a diol and the process for their preparation are described in detail in U.S. Pat. No. 2,425,845, the disclosure of which is incorporated herein by reference.

As noted above, the polyether polyols which contain a diol or polyol may either be used as such, or capped with an alpha olefin oxide. Advantageously, it was discovered that a substantially lesser amount of the capped polyol, whether including a diol or polyol, or aliphatic monohydric alcohol as the active hydrogen-containing compound, as compared to an uncapped polyol, could be used to provide a hydraulic fluid of a given viscosity. Thus, for example, in the hydraulic fluids of this invention, 4.8 parts by weight of a capped thickener were found to provide a hydraulic fluid with a viscosity of 190–200 SUS at 100° F., as compared to a viscosity of only 75–80 SUS using 12.5 parts of an uncapped thickener (cf. Examples I and II infra).

As previously stated, the alpha olefin oxides utilized to modify or cap the polyether polyols are those containing about 12 to 30, preferably about 12 to 18 aliphatic carbon atoms, and mixtures thereof. The amount of alpha olefin oxide required to obtain the desired thickeners is about 1 to about 20%, by weight of the total weight of the capped thickeners.

The capped reaction is carried out by adding the alpha olefin oxide to the polyether polyol, a liquid, and heating the mixture to a temperature of about 50° to 90° C. for about 1 to 2 hours, depending upon batch size. Before addition of alpha olefin oxide, it is desirable to render the polyether polyol as anhydrous as possible.

A second type of preferred thickeners are those heteric or block copolymers of ethylene oxide, a lower alkylene oxide and an active hydrogen compound which preferably is an aliphatic monohydroxy alcohol containing 4 to 30, preferably 12 to 18 aliphatic carbon atoms, capped with an alpha olefin oxide which also contains 12 to 30 aliphatic carbon atoms. Such thickeners and methods for their preparation are disclosed in U.S. Pat. No. 4,288,639, the disclosure of which patent is incorporated herein by reference.

Typical of the preferred monohydric alcohols for reaction with ethylene oxide and a lower alkylene oxide are butyl alciohol, capryl alcohol, lauryl alcohol, myristyl alcohol, stearyl alcohol, cetyl alcohol and behenyl alcohol. The reaction is carried out using well known alkaline oxyalkylation catalysts, for example, strong bases such as sodium and potassium hydroxides. The reaction can be carried out in the presence of an inert organic solvent, examples of which include aliphatic hydrocarbons, such as hexane and heptane; aromatic hydrocarbons, such as benzene and toluene; chlorinated hydrocarbons such as ethylene dichloride, and the like. Reaction temperatures are as stated above, i.e. on the order of 50° to 160° C.

Preparation of the latter polyether polyols is well known in the art. Further details of preparation of heteric copolymers of lower alkylene oxides are disclosed in U.S. Pat. No. 3,829,506, incorporated herein by reference. Additional information on preparation of block copolymers of lower alkylene oxides is to be found in U.S. Pat. No. 3,535,307, also incorporated herein by reference.

The polyether polyols in which the active hydrogen compound is an aliphatic monohydric alcohol may be capped with an alpha olefin oxide as described herein above.

The molecular weight of the latter discussed capped thickeners should be in the range of about 7,000 to 15,000, preferably 12,000 to 14,000.

Other polyether polyols which may be capped to provide thickeners according to this invention and methods for their preparation are disclosed in U.S. Pat. Nos. 2,425,755, 3,036,118, 3,595,924, 3,706,714, and 3,829,505; and British Pat. Nos. 950,844 and 1,228,561, the several disclosures of which are incorporated herein by reference.

In the hydraulic fluids of this invention, the thickeners will generally comprise from about 1.5 to about 15%, by weight, the amount depending upon the particular thickener employed and the viscosity which is desired for the hydraulic fluid. As noted above, the capped thickeners have greater thickening power than do the uncapped thickeners. Thus, lesser amounts of the capped thickeners can be used to provide the hydraulic fluids of the invention with a desired viscosity. Preferably, the hydraulic fluids contain on the average of about 2 to 6% of capped thickeners and 10 to 15% of uncapped thickeners. By using the preferred quantities of thickeners, the hydraulic fluids will have viscosities in the range of about 50 to about 200 SUS at 100° F.

THE DISPERSING AGENTS

Useful dispersing agents for inclusion in the hydraulic fluids of this invention are reaction products of an alkenyl succinic anhydride (or acid) with certain water-soluble active hydrogen compounds, an example of which is dialkyl alkanolamine. These dispersing agents are particularly effective in dispersing oil-soluble extreme pressure (EP) additives, such as zinc dialkyl dithiophosphate, in the aqueous fluid where it can act as an antiwear constituent and provide EP properties.

The alkenyl succinic anhydride (or acid) with which the active hydrogen compound is reacted may be prepared by reacting maleic anhydride with a long chain alpha olefin by conventional procedures. The olefin may be reacted with maleic anhydride (or acid) at temperatures of 150°–250° C., the amount of olefin used being at least the stoichiometric equivalent of the maleic anhydride reactant. A preferred olefin reaction product is a polyisobutene of sufficient chain length to provide the succinic anhydride reaction product with a molecular weight on the order of 500 to 2000, preferably about 800 to 1200, a molecular weight of about 1,000 being particularly preferred.

As to the other reactant, it is an active hydrogen compound and may be an alkyl alkanolamine having the formula $$\begin{array}{c} R-N-R'' \\ | \\ R' \end{array}$$

in which R is hydrogen or an alkyl group containing from 8 to 24 carbon atoms, R′ is hydrogen or $(C_2H_4O)_xH$ or $(C_3H_6O)_xH$, R″ is R or R′, and x is an integer of from 1 to 50. A particularly preferred alkyl alkanolamine reactant is diethylethanolamine.

Other active hydrogen compounds for reacting with the alkenyl succinic anhydride (or acid) have the formulae $HO(Z)_yOR'''$ $HO(Z)_yR^{iv}$, or

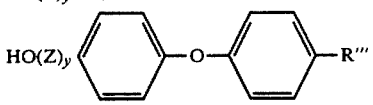

in which Z is $(C_2H_4O)$ or $(C_3H_6O)$, R''' is an alkyl group containing from 8 to 20 carbon atoms, $R^{iv}$ is

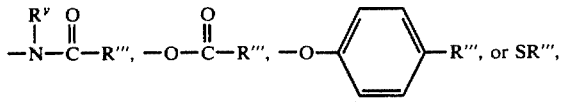

$R^v$ is R' or an alkyl group containing from 1 to 4 carbon atoms, and y is an integer from 3 to 10. Preferably, R''' is a $C_8$ to $C_9$ alkyl group and y is 5.

The alkenyl succinic anhydride (or acid) is reacted with the active hydrogen compound at a temperature of about 50° to 250° C., preferably 60° to 150° C. for a time sufficient to form the desired reaction product, usually from 1 to 6 hours. The relative amounts of anhydride and active hydrogen compound can vary somewhat, but preferably two mols of such compound are used with each mol of anhydride to ensure complete reaction of the anhydride.

The hydraulic fluid should contain on the order of from about 0.5 to about 5.0%, preferably 1 to 3%, of the dispersing agent in order to ensure proper dispersion of the EP additive and other water-insoluble constituents in the aqueous phase of the insoluble constituents in the aqueous phase of the hydraulic fluid.

THE EXTREME PRESSURE (EP) ADDITIVES

The extreme pressure (EP) additives used in hydraulic fluids of the invention are dithiophosphates or dithiocarbamates of the respective formulae

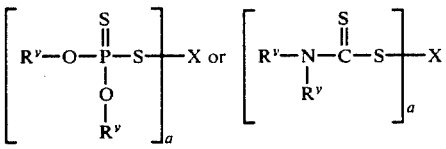

where $R^v$ is an alkyl group containing from 4 to 16, preferably 4 to 10 carbon atoms, phenyl or naphthyl, and X is hydrogen, an amine, ammonium, a substituted ammonium compound, a metal of Groups I and II of the Periodic Table, i.e. the alkali metals such as sodium, potassium or lithium, alkaline earth metals, usually magnesium or calcium, and the Group II transition metals, such as manganese or zinc, particularly zinc, which is preferred, antimony, or $Mo_2S_2O_2$, and a is an integer of from 1 to 2.

The dithiophosphates may be prepared by reacting an alcohol with phosphorous pentasulfide at a temperature of from 40°-120° C. for a period of 1 to 4 hours. Typical alcohols which may be used in the reaction are such normal alcohols as n-butyl, n-heptyl, n-octyl, n-decyl and n-dodecyl alcohol. Suitable branched chain alcohols include 2-methyl-1-pentanol, 2-ethyl-1-hexanol and 2,2-dimethyl-1-octanol.

An organic or inorganic base may be reacted with the dithiophosphate to form the EP additives for inclusion in the hydraulic fluid. Ashless dithiophosphates may be obtained by reaction with non-metallic base such as amines, ammonia and substituted ammonium compounds. Reaction with metal oxides or hydroxides produce ashing dithiophosphates which usually are preferred by reason of their properties.

The metals most usually used are those of Groups I and II of the Periodic Table, i.e. the alkali metals, such as sodium, potassium, and lithium, the alkaline earth metals, usually magnesium or calcium, and the Group II transition metals, particularly zinc, which is especially preferred. The metal is generally used in the form of its oxide or hydroxide for reaction with dithiophosphoric acid.

The reaction between the dithiophosphoric acid and the base is usually conducted at a temperature of 75°-150° C. over a period of 1-4 hours.

The EP additive should be present in an amount of from about 0.125 to 1.25%, preferably 0.5 to 0.75%.

The dithiocarbamates are well known compounds and generally may be obtained by reaction of suitable amine and carbon disulfide.

OPTIONAL ADDITIVES

In addition to the above essential constituents and water, the hydraulic fluids may also contain other materials such as emulsifiers, corrosion inhibitors, defoamers, coupling agents, and the like.

Suitable emulsifiers include those having a Hydrophile-Lipophile Balance (HLB) in the range of 3 to 20 (see Chapter 1 of the HLB System published by ICI United States, Inc. (1976)). Examples of such emulsifiers are ethoxylated alkyl phenols or alkyl amines in which the alkyl groups contain from 14 to 24 carbon atoms, and the number of ethoxy groups varies from 3 to 10. Long chain, e.g. $C_8$-$C_{18}$ alcohols can also be used as co-emulsifiers. The hydraulic fluid may contain up to 1.5% such an emulsifier, preferred amounts of emulsifier being from about 0.45 to 1.2%.

Small amounts, e.g. up to 0.5%, of various silicone defoamers may be present in the hydraulic fluid, as well as small amounts, e.g. up to 0.1% of various corrosion inhibitors, such as benzotriazole and tolutriazole. As a vapor phase corrosion inhibitor there may be used various water soluble alkyl alkanolamines of the type used to react with succinic anhydride to form the dispersing agents, described above. Freezing point depressants such as ethylene glycol, if not present as the lubricant modifier, may be included in the hydraulic fluids in amounts sufficient to lower the freezing point to prevent freezing of the fluids at those temperatures encountered in use.

In order to limit shipping and storage costs, in may be desirable to first prepare a water-dilutable concentrate from which the hydraulic fluid may be prepared merely by addition of an appropriate amount of water. Such a concentrate may have the composition given in TABLE I, below.

TABLE I

| Constituent | Generally | Preferred |
|---|---|---|
| Lubricant modifiers | 5-40 | 10-20 |
| Thickener | 5-20 | 12-18 |
| Dispersant | 5-20 | 10-15 |
| EP additive | 1-10 | 2-6 |
| Water | Balance | Balance |

In preparing a hydraulic fluid of this invention, the oil soluble lubricant modifier, if present, dispersing agent and EP additive may be mixed together and heated at a temperature of from about 130° to 150° F. (54.4°-65.6° C.) for 30-45 minutes. Various of the optional additives such as the corrosion inhibitors, defoamers, emulsifiers, etc. may be added to the water-miscible lubricant modifier, when present, which is heated to about 150°-160° F. (65.5°-71.1° C.). Otherwise such optional additives may be added directly to the mixture containing the oil soluble lubricant modifier and EP additive. The two mixtures can then be combined in the absence of heat, water added, and the mixture blended for 45-60 minutes to form a translucent fluid containing about 35-45% water. This mixture can then be combined with an appropriate amount of thickener and water to provide a hydraulic fluid of the desired water content, usually 80% or more, and viscosity.

In order that the invention may be better understood, several examples thereof will now be described, purely by way of illustration, without suggestion that the scope of the invention is limited to the details thereof.

EXAMPLE I

A hydraulic fluid of the present invention having the composition set forth in TABLE II was prepared by the method hereinbelow described:

TABLE II

| Component | Weight Percent |
|---|---|
| (a) Reaction product of polyisobutenyl succinic anhydride (ave. MW 1000) and diethylethanolamine | 1.17 |
| (b) Amide[1] | 0.9 |
| (c) EP additive[2] | 0.38 |
| (d) Polyglycol[3] | 0.5 |
| (e) Thickener[4] | 12.5 |
| (f) Diethylethanolamine | 0.5 |
| (g) Additives[5] | 0.06 |
| (h) Water | Balance |

[1]Phosphate-modified condensation product obtained by reacting about 1.5 mols of diethanolamine with about 1 mol of a mixture of stearic and oleic acids in the presence of about 0.03 mols of phosphoric acid.
[2]Zinc dialkyl ($C_4$-$C_{10}$) dithiophosphate.
[3]Monobutyl ether of poly(oxyethylene-oxy-1,2-propylene) glycol (MW 1500-4000).
[4]Poly(oxyethylene (75%)-oxy-1,2-propylene)glycol (MW 25,000-30,000).
[5]Benzotriazole and silicone defoamer.

23.3 parts by weight of component (a), 18.0 parts of component (b), and 7.5 parts of component (c), were mixed and heated to 130°-150° F. (54.4°-65.6° C.) for 30-45 minutes. 1.2 parts of the additives, component (g), were dissolved in 10.0 parts of component (d) which has been heated to 150°-160° F. (66°-71° C.). The two mixtures were combined; the heat was shut off, and water was added in an amount such that the water comprised 40% by weight of the final mixture. The resulting batch was blended for 45-60 minutes to obtain a uniformly translucent liquid.

5 parts by weight of the translucent liquid, prepared as above, were combined with 12.5 parts of diethyl ethanolamine, component (f), in sufficient water so that the total of all materials was 100%. The resulting hydraulic fluid has an initial viscosity of 75-80 SUS at 100° F. (37.8° C.).

EXAMPLE II

The hydraulic fluid of Example I was subjected to the following pump test:

TABLE III

| | Test Conditions | |
|---|---|---|
| Pump | Vickers V-104-C-10 Vane Pump | |
| Pressure, psi | 800 | |
| Speed, rpm | 1200 | |
| Output (theoretical) gpm | 7.5 | |
| Sump temperature °F. | 115-120 (46°-49° C.) | |
| Filter size, microns | 10 | |
| | Test Results | |
| | Test #1 | Test #2 |
| Ring Wear Loss, mgs. | 1678 | 244 |
| Vanes Wear Loss, mgs. | 5 | 3 |
| Total Wear Loss | 1683 | 247 |
| Wear Rate, mgs/hr. | 12.2 | 5.5 |
| Viscosity Loss, % | 2.3 | 5.6 |
| Duration, hrs. | 138 | 45 |

EXAMPLE III

A hydraulic fluid of the present invention having the composition set forth in TABLE IV was prepared by the method hereinbelow described:

TABLE IV

| Component | Weight Percent |
|---|---|
| (a) Reaction product of polyisobutenyl succinic anhydride (ave. MW 1000) and diethylethanolamine | 1.17 |
| (b) Amide[1] | 0.9 |
| (c) EP additive[2] | 0.38 |
| (d) Polyglycol[3] | 0.5 |
| (e) Thickener[4] | 4.8 |
| (f) Diethylethanolamine | 0.5 |
| (g) Additives[5] | 0.06 |
| (h) Water | Balance |

[1]Phosphate-modified condensation product obtained by reacting about 1.5 mols of diethanolamine with about 1 mol of a mixture of stearic and oleic acids in the presence of about 0.03 mols of phosphoric acid.
[2]Zinc dialkyl ($C_4$-$C_{10}$) dithiophosphate.
[3]Monobutyl ether of poly(oxyethylene-oxy-1,2-propylene) glycol (MW 1500-4000).
[4]Poly(oxyethylene (75%)-oxy-1,2-propylene)glycol (MW 12,000 15,000) capped with $CH_3(CH_2)_{13}CH{-}CH_2$ (MW ~ 240).
O
[5]Benzotriazole and silicone defoamer.

23.3 parts by weight of component (a), 18.0 parts of component (b), and 7.5 parts of component (c), were mixed and heated to 130°-150° F. (54.4°-65.6° C.). for 30-45 minutes. 1.2 parts of the additives, component (g), were dissolved in 10.0 parts of component (d) which has been heated to 150°-160° F. (65.6°-71.1° C.). The two mixtures were combined; the heat was shut off, and water was added in an amount such that the water comprised 40% by weight of the final mixture. The resulting batch was blended for 45-60 minutes to obtain a uniformly translucent liquid.

5 parts by weight of the translucent liquid, prepared as above, were combined with 4.8 parts of the thickener, component (e), and 0.5 parts of diethylethanolamine, component (f), in sufficient water so that the total of all materials was 100%. The resulting hydraulic fluid had an initial viscosity of 190-200 SUS at 100° F. (37.8° C.).

EXAMPLE IV

The hydraulic fluid of Example III was subjected to the following pump test:

TABLE V

| | Test Conditions |
|---|---|
| Pump | Vickers V-104-C-10 Vane Pump |

TABLE V-continued

| | |
|---|---|
| Pressure, psi | 1000 |
| Speed, rpm | 1200 |
| Output (theoretical) gpm | 7.5 |
| Sump temperature °F. | 120 (49° C.) |
| Filter size, microns | 10 |

| | Test Results | |
|---|---|---|
| | Test #1 | Test #2 |
| Ring Wear Loss, mgs. | 1871 | 885 |
| Vanes Wear Loss, mgs. | 35 | 15 |
| Total Wear Loss | 1906 | 900 |
| Wear Rate, mgs/hr. | 20.7 | 20.0 |
| Viscosity Loss, % | 6.2 | 2.6 |
| Duration, hrs. | 92 | 45 |

EXAMPLE V

A hydraulic fluid of the present invention having the composition set forth in TABLE VI was prepared by the method hereinbelow described:

TABLE VI

| Component | Weight Percent |
|---|---|
| (a) Dispersant[1] | 1.06 |
| (b) Hydrocarbon oil[2] | 0.80 |
| (c) EP additive[3] | 0.34 |
| (d) Polyglycol[4] | 5.0 |
| (e) Thickener[5] | 5.0 |
| (f) Additives[6] | 0.03 |
| (g) Diethylethanolamine | 0.38 |
| (h) Fatty alcohol | 0.23 |
| (i) Water | Balance |

[1]Reaction product of poly isobutenyl succinic anhydride (ave. MW 1000) and ethoxylated (3-10) ethoxy groups) fatty ($C_{12}$-$C_{24}$) amine.
[2]Polybutene (visc. ~400 SUS at 100° F.).
[3]Zinc dialkyl ($C_2$-$C_{10}$) dithiophosphate.
[4]Monobutyl ether of poly(oxyethylene-oxy-1,2-propylene) glycol (MW 1500-4000).
[5]Poly(oxyethylene (75%)-oxy-1,2-propylene)glycol (MW 25,000-30,000) capped with $CH_3(CH_2)_{13}CH(\diagdown O \diagup)CH_2$
[6]Benzotriazole and silicone defoamer.

21.2 parts by weight of component (a) and 16.0 parts of component (b) were mixed and heated to 130°-150° F. (54.4°-65.6° C.) for 45-60 minutes. The heat was shut off and 6.7 parts of component (c) and 7.5 parts of component (g) were added, and the mixture was blended for 30-45 minutes. 0.9 parts of the additive, component (f), were dissolved in 4.5 parts of component (h) which had been heated to 150°-160° F. (65.6°-71.1° C.). The two mixtures were combined. Water was added in an amount such that the water comprised 43.2% by weight of the final mixture. The resulting batch was blended for 45-60 minutes to obtain a uniformly translucent liquid.

5 parts by weight of the translucent liquid, prepared as above, were combined with 5 parts of the thickener, component (e), and 5 parts of the polyglycol, component (d), in sufficient water so that the total of all materials was 100%. The resulting hydraulic fluid has an initial viscosity of 150-250 SUS at 100° F. (37.8° C.).

EXAMPLE VI

The hydraulic fluid of Example V was subjected to the following pump test using the same type of test pump and the same test conditions as in Example IV, TABLE V.

TABLE VII

| | Test Results | | | |
|---|---|---|---|---|
| | Test #1 | Test #2 | Test #3 | Test #4 |
| Duration; hrs. | 307 | 452 | 336 | 300 |

TABLE VII-continued

| | Test Results | | | |
|---|---|---|---|---|
| | Test #1 | Test #2 | Test #3 | Test #4 |
| Ring Wear Loss, mgs | 620 | 1184 | 424 | 997 |
| Vanes Wear Loss, mgs | 30 | 33 | 25 | 11 |
| Total Wear Loss | 650 | 1217 | 449 | 1008 |
| Viscosity Change, % | +21.0 | −12.2 | nil | +5.3 |

EXAMPLE VII

A hydraulic fluid of the present invention having the composition set forth in TABLE VIII was prepared by the method hereinbelow described:

TABLE VIII

| Component | Weight Percent |
|---|---|
| (a) Reaction product of polyisobutenyl succinic anhydride (ave. MW 1000) and diethylethanolamine | 1.25 |
| (b) Amide[1] | 1.0 |
| (c) EP additive[2] | 0.5 |
| (d) Polyglycol[3] | 2.19 |
| (e) Thickener[4] | 12.0 |
| (f) Diethylethanolamine | 0.5 |
| (g) Additives[5] | 0.06 |
| (h) Water | Balance |

[1]Phosphate-modified condensation product obtained by reacting about 1.5 mols of diethanolamine with about 1 mol of a mixture of stearic and oleic acids in the presence of about 0.03 mols of phosphoric acid.
[2]Zinc dialkyl ($C_4$-$C_{10}$) dithiophosphate.
[3]Monobutyl ether of poly(oxyethylene-oxy-1,2-propylene) glycol (MW 1500-4000).
[4]Poly(oxyethylene (75%)-oxy-1,2-propylene)glycol (MW 25,000-30,000).
[5]Benzotriazole and silicone defoamer.

12.5 parts by weight of component (a), 10.0 parts of component (b), and 5.0 parts of component (c), were mixed and heated to 130°-150° F. (54.4°-65.6° C.) for 30-45 minutes. 0.6 parts of the additives, component (g), were dissolved in 21.9 parts of component (d) which has been heated to 150°-160° F. (65.6°-71.1° C.). The two mixtures were combined; the heat was shut off, and water was added in an amount such that the water comprised 50% by weight of the final mixture. The resulting batch was blended for 45-60 minutes to obtain a uniformly translucent liquid.

10.0 parts by weight of the translucent liquid, prepared as above, were combined with 12.0 parts of the thickener, component (e), and 0.5 parts of diethylethanolamine, component (f), in sufficient water so that the total of all materials was 100%. The resulting hydraulic fluid had an initial viscosity of 70-75 SUS at 100° F. (37.8° C.).

EXAMPLE VIII

The hydraulic fluid of Example VII was subjected to the following pump test:

TABLE IX

| | Test Conditions |
|---|---|
| Pump | Vickers V-104-C-10 Vane Pump |
| Pressure, psi | 1000 |
| Speed, rpm | 1200 |
| Output (theoretical) gpm | 7.5 |
| Sump temperature °F. | 125-140 (51.6°-60° C.) |
| Filter size, microns | 10 |

| | Test Results | |
|---|---|---|
| | Test #1 | Test #2 |
| Ring Wear Loss, mgs. | 85 | 113 |
| Vanes Wear Loss, mgs. | 9 | 1 |
| Total Wear Loss | 94 | 114 |
| Wear Rate, mgs/hr. | 0.36 | 0.95 |
| Viscosity Loss, % | 1.4 | 3.8 |

TABLE IX-continued

| Duration, hrs. | 264 | 120 |
|---|---|---|

EXAMPLE IX

The hydraulic fluid of Example V was subjected to the following pump test:

TABLE X

| Test Conditions | | |
|---|---|---|
| Pump | Vickers F6-35V25 Vane Pump | |
| Pressure, psi | 1000 | |
| Speed, rpm | 1200 | |
| Output (theoretical) gpm | 25 | |
| Sump temperature °F. | 120 (49° C.) | |
| Filter size, microns | 25 | |
| **Test Results** | | |
| | Test #1 | Test #2 |
| Ring Wear Loss, mgs. | 300 | 100 |
| Vanes Wear Loss, mgs. | 4 | 6 |
| Total Wear Loss | 304 | 106 |
| Wear Rate, mgs/hr. | 0.99 | 0.34 |
| Viscosity Loss, % | 3.5 | 14.8 |
| Duration, hrs. | 308 | 308 |

EXAMPLE X

A hydraulic fluid of the present invention having the composition set forth on Table XI was prepared by the method herein below described:

TABLE XI

| Components | Weight Percent |
|---|---|
| (a) Dispersant[1] | 2.50 |
| (b) Hydrocarbon oil[2] | 1.50 |
| (c) Diethylethanolamine | .72 |
| (d) EP additive[3] | .65 |
| (e) Fatty alcohol | .42 |
| (f) Additives[4] | .23 |
| (g) Ethylene glycol | 2.50 |
| (h) Thickeners[5] | 3.00 |
| (i) Water | Balance |

[1]Reaction product of polyisobutenyl succinic anhydride (Ave. MW 1000) and ethoxylated (3-10 ethoxy groups) fatty ($C_{12}$-$C_{24}$) amine
[2]Naphthenic mineral oil (visc ~ 100 SUS at 100° F.)
[3]Zinc dialkyl ($_4$-$C_{10}$) dithiophosphate
[4]Benzotriozole and silicone defoamer
[5]Poly (oxyethylene-(75%)-oxy-1,2-propylene)glycol (MW 12,000-15,000) capped with $CH_3(CH_2)_{13}CH\underset{O}{\diagdown\diagup}CH_2$ 38.5 parts of component (a) and 14.0 parts of component (b) were mixed and heated to 130°-150° F. (54°-66° C.) for 45-60 minutes. The heat was shut off and 11.0 parts of component (c) and 10.0 parts of component (d) were added, and the mixture was blended for 30-45 minutes. 0.3 parts of benzotriazole were dissolved in 6.5 parts of component (e) which had been heated to 150°-160° F. (66°-71° C.). The two mixtures were combined. 10.7 parts of water were added, and the mixture was blended for 45-60 minutes to obtain a uniformly transparent liquid.

6.5 parts by weight of the transparent liquid, prepared as above were combined with 87.8 parts of water, 2.5 parts of ethylene glycol, 3.0 parts of component (i) and 0.2 parts of silicone defoamer. This mixture was blended for 45-60 minutes until a uniform translucent product was obtained. The resulting hydraulic fluid had an initial viscosity of 210-320 SUS.

EXAMPLE XI

The hydraulic fluid of Example X was subjected to pump tests using the same type of pump and the same conditions as in Example IV, Table V, except for duration of the tests. The results of these tests are set forth in Table XII, below.

TABLE XII

| Text Results | | | | | |
|---|---|---|---|---|---|
| Test No. | 1 | 2 | 3 | 4 | 5 |
| Duration, hrs. | 1146 | 1008 | 616 | 232 | 881 |
| Ring Wear Loss, mgs | 54 | 181 | 12 | 11 | 13 |
| Vanes Wear Loss, mgs | 33 | 20 | 19 | 7 | 25 |
| Total Wear Loss, mgs | 87 | 201 | 31 | 18 | 38 |
| Wear Rate, mgs/hr | 0.08 | 0.20 | 0.05 | 0.08 | 0.04 |
| Viscosity: | | | | | |
| Initial, SUS @ 100° F. | 320 | 260 | 250 | 246 | 233 |
| Final, SUS @ 100° F. | 205 | 175 | 366 | 344 | 176 |

EXAMPLE XII

The hydraulic fluid of Example X was subjected to the following pump tests, and the test conditions used and results obtained are set forth in Table XIII, below:

TABLE XIII

| TEST CONDITIONS | | | |
|---|---|---|---|
| Pump | Vickers 25 V17 A Intravane Pump | | |
| Pressure, psi | 1000 | | |
| Speed, rpm | 1200 | | |
| Output (theoritical) gpm | 17 | | |
| Sump temperature, °F. | 115-120 | | |
| Filter size, microns | 25 | | |
| **Test Results** | | | |
| Test No. | 1 | 2 | 3 |
| Duration, hrs. | 1172 | 476 | 1148 |
| Ring Wear Loss, mgs | Nil | 5 | 170 |
| Vanes Wear Loss, mgs | 6 | 5 | 17 |
| Intravane Wear Loss, mgs | 2 | 3 | 5 |
| Total Wear Loss, mgs | 8 | 13 | 194 |
| Wear Rate, mgs/hr | 0.007 | 0.027 | 0.17 |
| Viscosity: | | | |
| Initial, SUS | 303 | 225 | 230 |
| Final, SUS | 252 | 245 | 247 |

Note:
(1) Tests 1 and 2 were run with negative head condition using the Vickers 282 series vane pump.
(2) Test 3 was run with 12 inch supercharge inlet condition using Vickers 180 series vane pump.

EXAMPLE XIII

The hydraulic fluid of Example X was subjected to pump tests using the same type of pump and the same conditions as in Example IX, Table X except for duration of the tests, and the results obtained are set forth in Table XIV, below:

TABLE XIV

| TEST RESULTS | | |
|---|---|---|
| Test No. | 1 | 2 |
| Duration, hrs. | 1080 | 706 |
| Ring Wear loss, mgs | 50 | 100 |
| Vanes Wear Loss, mgs | 8 | 5 |
| Total Wear Loss, mgs | 58 | 105 |
| Wear Rate, mgs/hr | 0.054 | 0.15 |
| Viscosity | | |
| Initial, SUS @ 100° F. | 310 | 240 |
| Final, SUS @ 100° F. | 183 | 267 |

I claim:

1. A high water-based hydraulic fluid in the form of an oil-in-water emulsion comprising (1) from about 1.5 to about 15% of a polyether-based thickener, (2) from about 0.5 to about 20% of a lubricant modifier (3) from about 0.5 to about 5.0% of a dispersing agent which is the reaction product of an alkenyl succinic anhydride or acid and a water soluble active hydrogen compound, (4) from about 0.125 to about 1.25% of an extreme pressure additive comprising a dialkyl or diaryl dithiophosphate, or a dialkyl or diaryl dithiocarbamate, and (5) balance water, said percentages being by weight based on the total weight of the fluid.

2. A hydraulic fluid according to claim 1 in which said thickener comprises a polyether polyol prepared by reacting ethylene oxide and at least one lower alkylene oxide having 3 to 4 carbon atoms with at least one active hydrogen compound initiator to prepare a heteric or block copolymer, and further reacting said copolymer with at least one alpha olefin oxide, said polyol having a molecular weight of from about 7,000 to 15,000.

3. A hydraulic fluid according to claim 2 in which said active hydrogen compound is a diol or polyol.

4. A hydraulic fluid according to claim 2 in which said active hydrogen compound is an aliphatic monohydric alcohol containing from 4 to 30 carbon atoms.

5. A hydraulic fluid according to claim 1 in which said thickener comprises a polyether polyol prepared by reacting a diol or polyol, ethylene oxide and at least one lower alkylene oxide having 3 to 4 carbon atoms to form a heteric or block copolymer, said copolymer having a molecular weight of from about 7,000 to 75,000.

6. A hydraulic fluid according to claim 2 in which said thickener comprises a polyether polyol prepared by reacting ethylene oxide and propylene oxide with a lower glycol or polyol to form a block copolymer, and further reacting said copolymer with an alpha olefin oxide containing from 12 to 30 aliphatic carbon atoms, said polyether having a molecular weight of from about 7,000 to 15,000.

7. A hydraulic fluid according to claim 4 in which said thickener comprises a polyether prepared by reacting ethylene oxide, propylene oxide and an aliphatic alcohol containing 12 to 18 aliphatic carbon atoms to form a block copolymer, and further reacting said block copolymer with an alpha olefin oxide containing from about 12 to 30 aliphatic carbon atoms, said polyether having a molecular weight of from about 7,000 to 15,000.

8. A hydraulic fluid according to claim 6 in which said active hydrogen compound is ethylene glycol.

9. A hydraulic fluid according to claim 1 in which said lubricant modifier is selected from the group consisting of aliphatic hydrocarbons, cycloaliphatic hydrocarbons, aromatic hydrocarbons, mineral oils, silicone oils, synthetic hydrocarbon oils, glycerides, fatty alcohols, condensation products of fatty acids and alkanolamines, phosphate-modified condensation products of fatty acids and alkanolamines, ethoxylated fatty amines, glycols, polyglycols, ethoxylated vegetable oils, ethoxylated fatty amides, organic esters, triaryl phosphate esters and polyphenyl ethers, and mixtures thereof.

10. A hydraulic fluid according to claim 9 in which said lubricant modifier comprises a polybutene having a viscosity of about 400 SUS at 100° F.

11. A hydraulic fluid according to claim 9 in which said lubricant modifier is a phosphate-modified condensation product of a fatty acid and a dialkanolamine.

12. A hydraulic fluid according to claim 9 in which said lubricant modifier is a light lubricating oil of the naphthenic type having a viscosity of about 100 SUS at 100° F.

13. A hydraulic fluid according to claim 9 in which said lubricant modifier is ethylene glycol.

14. A hydraulic fluid according to claim 9 in which said lubricant modifier is a monobutyl ether of poly(oxyethylene-oxy-1,2-propylene) glycol having a molecular weight of from about 1,500 to 4,000.

15. A hydraulic fluid according to claim 9 in which said lubricant modifier comprises a mixture of a phosphate-modified condensation product of a fatty acid and a dialkanolamine, and a monobutyl ether of poly(oxyethylene-oxy-1,2-propylene) glycol.

16. A hydraulic fluid according to claim 9 in which said lubricant modifier comprises a mixture of a polybutene, a polyglycol and a fatty alcohol.

17. A hydraulic fluid according to claim 9 in which said lubricant modifier comprises a mixture of a mineral oil, a fatty alcohol and a glycol.

18. A hydraulic fluid according to claim 9 in which said lubricant modifier comprises a mixture of a fatty alcohol and a glycol.

19. A hydraulic fluid according to claim 1 in which said ester of succinic anhydride or acid comprises the reaction product of an alkenyl succinic anhydride or acid, and an alkyl alkanolamine of the formula

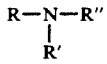

in which R is hydrogen or an alkyl group containing from about 8 to 25 carbon atoms, R′ is hydrogen $(C_2H_4O)_xH$ or $C_3H_6O)_xH$, R″ is R or R′ and x is an integer of from 2 to 50, said reaction product having a molecular weight of from about 800 to 2000.

20. A hydraulic fluid according to claim 19 in which said ester of succinic anhydride comprises the reaction product of polyisobutenyl succinic anhydride having a molecular weight of about 1,000 and diethyl ethanolamine.

21. A hydraulic fluid according to claim 1 in which said dispersing agent is an ester of an alkenyl succinic anhydride or acid and ethoxylated castor oil.

22. A hydraulic fluid according to claim 1 in which said dispersing agent is an ester of succinic anhydride or acid and an ethoxylated fatty amine.

23. A hydraulic fluid according to claim 1 in which said dispersing agent is the reaction product of succinic anhydride or acid and a compound of the formulae

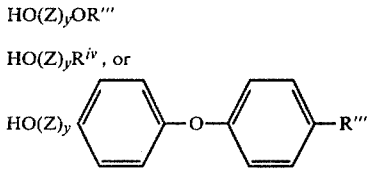

in which Z is $(C_2H_4O)$ or $(C_3H_6O)$, R‴ is an alkyl group containing from 8 to 20 carbon atoms, $R^{iv}$ is

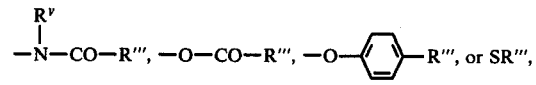

$R^y$ is R' or an alkyl group containing from 1 to 4 carbon atoms, and y is an integer from 3 to 10.

24. A hydraulic fluid according to claim 1 in which said extreme pressure additive has the formulae

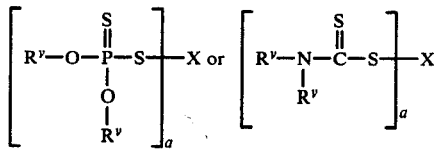

in which $R^y$ is an alkyl group containing from 4 to 16 carbon atoms, phenyl or naphthyl, X is hydrogen, an amine, ammonium or substituted ammonium, sodium, potassium, lithium, calcium, magnesium, maganese or zinc, and a is an integer of from 1 to 2.

25. A hydraulic fluid according to claim 24 in which said extreme pressure additive is a zinc dialkyl dithiophosphate.

26. A hydraulic fluid according to claim 24 in which said extreme pressure additive is a zinc dialkyl dithiophosphate in which the alkyl groups contain from about 4 to about 10 carbon atoms.

27. A hydraulic fluid according to claim 1 containing at least 80%, by weight, of water.

28. A high water-based hydraulic fluid in the form of an oil-in-water emulsion comprising (1) from about 2 to about 6% of a thickener comprising a polyether polyol prepared by reacting ethylene oxide, propylene oxide and a lower glycol or polyol to form a block copolymer, and further reacting said block copolymer with an alpha olefin oxide containing from about 12 to about 18 aliphatic carbon atoms, said polyether having a molecular weight of from about 12,000 to about 14,000 (2) from about 1 to about 10% of a lubricant modifier (3) from about 1 to about 3% of a dispersing agent comprising the reaction product of polyisobutenyl succinic anhydride and diethyl ethanolamine said reaction product having a molecular weight of about 1,000, (4) from about 0.5 to about 0.75% of a zinc dialkyl dithiophosphate in which the alkyl groups contain from about 4 to about 10 carbon atoms, and (5) balance water, said percentages being by weight based on the total weight of the fluid, said fluid containing at least 80% water.

29. A concentrate for forming a high water-based hydraulic fluid by addition of water thereto comprising (1) from about 5 to 20% of a polyether-based thickener, (2) from about 5 to about 40% of a lubricant modifier, (3) from about 5 to about 20% of a dispersing agent which is the reaction product of an alkenyl succinic anhydride or acid and a water soluble active hydrogen compound, (4) from about 1 to about 10% of an extreme pressure additive comprising a dialkyl or diaryl dithiophosphate, or a dialkyl or diaryl dithiocarbamate, and (5) balance water, said percentages being by weight based on the total weight of the fluid.

30. A concentrate according to claim 29 in which said thickener comprises a polyether polyol prepared by reacting ethylene oxide and at least one lower alkylene oxide having 3 to 4 carbon atoms with at least one active hydrogen compound initiator to prepare a heteric or block copolymer, and further reacting said copolymer with at least one alpha olefin oxide, said polyol having a molecular weight of from about 7,000 to 15,000.

31. A concentrate according to claim 30 in which said active hydrogen compound is a diol or polyol.

32. A concentrate according to claim 30 in which said active hydrogen compound is an aliphatic monohydric alcohol containing from 4 to 30 carbon atoms.

33. A concentrate according to claim 29 in which said thickener comprises a polyether polyol prepared by reacting a diol or polyol, ethylene oxide and at least one lower alkylene oxide having 3 to 4 carbon atoms to form a heteric or block copolymer said copolymer having a molecular weight of from about 7,000 to 75,000.

34. A concentrate according to claim 30 in which said thickener comprises a polyether polyol prepared by reacting ethylene oxide and propylene oxide with a lower glycol or polyol to form a block copolymer, and further reacting said copolymer with an alpha olefin oxide containing from 12 to 30 aliphatic carbon atoms, said polyether having a molecular weight of from about 7,000 to 15,000.

35. A concentrate according to claim 32 in which said thickener comprises a polyether prepared by reacting ethylene oxide, propylene oxide and an aliphatic alcohol containing 12 to 18 aliphatic carbon atoms to form a block copolymer, and further reacting said block copolymer with an alpha olefin oxide containing from about 12 to 30 aliphatic carbon atoms, said polyether having a molecular weight of from about 7,000 to 15,000.

36. A concentrate according to claim 29 in which said active hydrogen compound is ethylene glycol.

37. A concentrate according to claim 29 in which said lubricant modifier is selected from the group consisting of aliphatic hydrocarbons, cycloaliphatic hydrocarbons, aromatic hydrocarbons, mineral oils, silicone oils, synthetic hydrocarbons oils, glycerides, condensation products of fatty acids and alkanolamines, phosphate-modified condensation products of fatty acids and alkanolamines, ethoxylated fatty amines, ethoxylated vegetable oils, ethoxylated fatty amides, organic esters, glycols, polyglycols, triaryl phosphate esters and polyphenyl ethers.

38. A concentrate according to claim 37 in which said lubricant modifier comprises a polybutene having a viscosity of about 400 SUS at 100° F.

39. A concentrate according to claim 37 in which said lubricant modifier is a phosphate-modified condensation product of a fatty acid and a dialkanolamine.

40. A concentrate according to claim 29 in which said lubricant modifier is a light lubricating oil of the naphthenic type having a viscosity of about 100 SUS at 100° F.

41. A concentrate according to claim 29 in which said lubricant modifier is ethylene glycol.

42. A concentrate according to claim 29 in which said lubricant modifier is a monobutyl ether of poly (oxyethylene-oxy-1,2-propylene) glycol having a molecular weight of from about 1,500 to 4,000.

43. A concentrate according to claim 29 in which said lubricant modifier comprises a mixture of a phosphate modified condensation product of a fatty acid an a dialkanolamine, and a monobutyl ether of poly(oxyethylene-oxy-1,2-propylene) glycol.

44. A concentrate according to claim 29 in which said lubricant modifier comprises a mixture of a polybutene, a polygycol and a fatty alcohol.

45. A concentrate according to claim 29 in which said lubricant modifier comprises a mixture of a mineral oil, a fatty alcohol and a glycol.

46. A hydraulic fluid according to claim 29 in which said lubricant modifier comprises a mixture of a fatty alcohol and a glycol.

47. A concentrate according to claim 29 in which said ester of succinic anhydride or acid comprises the reaction product of an alkenyl succinic anhydride or acid, and an alkyl alkanolamine of the formula

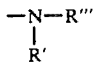

in which R is hydrogen or an alkyl group containing from about 8 to 25 carbon atoms, R′ is hydrogen $(C_2H_4O)_xH$ or $(C_3H_6O)_x$ H, R″ is R or R′ and x is an enteger of from 2 to 50, said reaction product having a molecular weight of from about 200 to 2000.

48. A concentrate according to claim 47 in which said ester of succinic anhydride comprises the reaction product of polyisobutenyl succinic anhydride having a molecular weight of about 1,000 and diethyl ethanolamine.

49. A concentrate according to claim 29 in which said dispersing agent is an ester of an alkenyl succinic anhydride or acid and ethoxylated castor oil.

50. A concentrate according to claim 29 in which said dispersing agent is an ester of succinic anhydride or acid and an ethoxylated fatty amine.

51. A concentrate according to claim 29 in which said dispersing agent is the reaction product of succinic anhydride or acid and a compound of the formulae

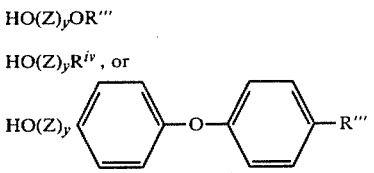

in which Z is $(C_2H_4O)$ or $(C_3H_6O)$, R‴ is an alkyl group containing from 8 to 20 carbon atoms, $R^{iv}$ is

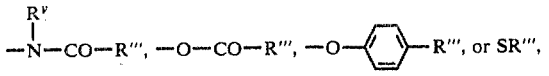

$R^v$ is R′ or an alkyl group containing from 1 to 4 carbon atoms, and y is an integer from 3 to 10.

52. A concentrate according to claim 29 in which said extreme pressure additive has the formulae

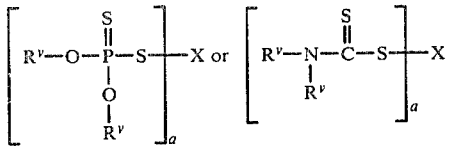

in which $R^v$ is an alkyl group containing from 4 to 16 carbon atoms, phenyl or naphtyl, X is hydrogen, an amine, ammonium or substituted ammonium, sodium, potassium, lithium, calcium, magnesium, manganese or zinc, and a is an integer of from 1 to 2.

53. A concentrate according to claim 52 in which said extreme pressure additive is a zinc dialkyl dithiophosphate.

54. A concentrate according to claim 52 in which said extreme pressure additive is a zinc dialkyl dithiophosphate in which the alkyl groups contain from about 4 to about 10 carbon atoms.

55. A hydraulic fluid according to claim 29 containing at least 80%, by weight, of water.

56. A concentrate for forming a high water-based hydraulic fluid by the addition of water thereto comprising (1) from about 12 to about 18% of a thickener comprising a polyether polyol prepared by reacting ethylene oxide, propylene oxide and a lower glycol or polyol to form a block copolymer, and further reacting said block copolymer with an alpha olefin oxide containing from about 12 to about 18 aliphatic carbon atoms, said polyether having a molecular weight of from about 12,000 to about 14,000 (2) from about 10 to about 20% of a lubricant modifier, (3) from about 10 to about 15% of a dispersing agent comprising the reaction product of polyisobutenyl succinic anhydride and diethylethanolamine said reaction product having a molecular weight of about 1,000, (4) from about 2 to about 6% of a zinc dialkyl dithiophosphate in which the alkyl groups contain from about 4 to about 10 carbon atoms, and (5) balance water, said percentages being by weight based on the total weight of the fluid.

* * * * *